US011390926B2

(12) United States Patent
Hage et al.

(10) Patent No.: US 11,390,926 B2
(45) Date of Patent: Jul. 19, 2022

(54) METHOD FOR OFF-GAS COMPOSITION CONTROL IN A METAL SMELTING APPARATUS

(71) Applicant: TATA STEEL NEDERLAND TECHNOLOGY B.V., Velsen-Noord (NL)

(72) Inventors: Johannes Hage, Bilthoven (NL); Hendrikus Koenraad Albertus Meijer, Bergen (NL); Christiaan Zeilstra, Haarlem (NL)

(73) Assignee: TATA STEEL NEDERLAND TECHNOLOGY B.V., Velsen-Noord (NL)

( * ) Notice: Subject to any disclaimer, the term of this patent is extended or adjusted under 35 U.S.C. 154(b) by 0 days.

(21) Appl. No.: 17/041,712

(22) PCT Filed: Mar. 29, 2019

(86) PCT No.: PCT/EP2019/058004

§ 371 (c)(1),
(2) Date: Sep. 25, 2020

(87) PCT Pub. No.: WO2019/185866

PCT Pub. Date: Oct. 3, 2019

(65) Prior Publication Data

US 2021/0040572 A1 Feb. 11, 2021

(30) Foreign Application Priority Data

Mar. 30, 2018 (EP) ..... 18165337
Dec. 21, 2018 (EP) ..... 18215358

(51) Int. Cl.
*C21B 13/00* (2006.01)
*C21B 11/08* (2006.01)

(52) U.S. Cl.
CPC ..... *C21B 13/0026* (2013.01); *C21B 11/08* (2013.01); *C21B 13/008* (2013.01)

(58) Field of Classification Search
CPC ... C21B 13/0026; C21B 11/08; C21B 13/008; Y02P 10/122
(Continued)

(56) References Cited

U.S. PATENT DOCUMENTS 4,617,051 A 10/1986 Knop et al.
4,880,458 A 11/1989 Martinez-Vera et al.
(Continued)

FOREIGN PATENT DOCUMENTS

EP 0097803 A2 1/1984
EP 0446860 A1 9/1991
(Continued)

OTHER PUBLICATIONS

International Search Report and Written Opinion dated May 15, 2019 for PCT/EP2019/058004 to Tata Steel Nederland Technology B.V. filed Mar. 29, 2019.

*Primary Examiner* — Brian D Walck
*Assistant Examiner* — Danielle Carda
(74) *Attorney, Agent, or Firm* — Vorys, Sater, Seymour and Pease LLP

(57) ABSTRACT

A method for off-gas composition control, wherein the off-gas results from a smelting apparatus for smelting a metalliferous feed material, wherein the smelting apparatus includes a smelting vessel, a smelt cyclone mounted on the smelting vessel and in connection with the inside of the smelting vessel and an off-gas duct connected to the smelt cyclone, wherein the method provides that an oxygen containing gas containing 95% oxygen or more is injected into the smelt cyclone and that the feed material is injected into the smelt cyclone with a carrier gas other than nitrogen gas.

21 Claims, 1 Drawing Sheet

(58) Field of Classification Search
USPC ..... 75/453; 74/453
See application file for complete search history.

(56) References Cited

U.S. PATENT DOCUMENTS

| | | | | |
|---|---|---|---|---|
| 5,611,838 | A | 3/1997 | Fritz et al. | |
| 6,440,195 | B1 * | 8/2002 | Dry | F27D 13/00 75/453 |
| 8,052,921 | B2 * | 11/2011 | Shin | B01J 8/44 266/172 |
| 2010/0050812 | A1 * | 3/2010 | Van Heeringen | C01B 3/36 75/392 |
| 2016/0303502 | A1 * | 10/2016 | Higgins | B01D 47/10 |
| 2017/0176104 | A1 * | 6/2017 | Davis | C21C 7/076 |

FOREIGN PATENT DOCUMENTS

| | | | |
|---|---|---|---|
| EP | 0657549 | A1 | 6/1995 |
| EP | 3077552 | A1 | 10/2016 |
| WO | 0022176 | A1 | 4/2000 |
| WO | 2010020655 | A1 | 2/2010 |
| WO | 2015081376 | A1 | 6/2015 |

* cited by examiner

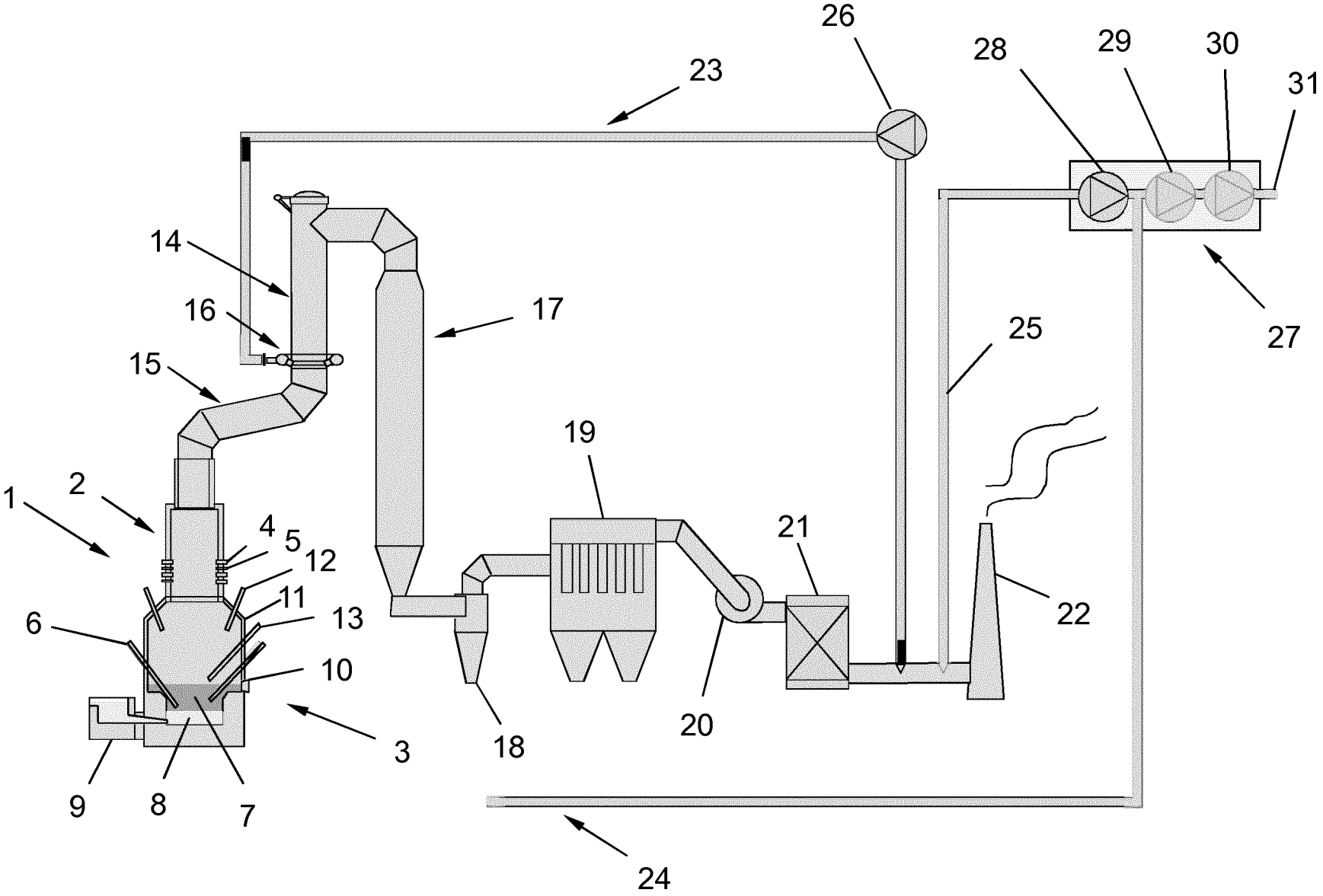
31
30
29
28
27
26
25
22
23
21
20
19
24
17
18
3
13
10
12
5
11
4
7
14
16
15
8
2
9
1
6

METHOD FOR OFF-GAS COMPOSITION CONTROL IN A METAL SMELTING APPARATUS

CROSS-REFERENCE TO RELATED APPLICATIONS

This is a § 371 National Stage Application of International Application No. PCT/EP2019/058004 filed on Mar. 29, 2019, claiming the priority of European Patent Application No. 18165337.9 filed on Mar. 30, 2018 and European Patent Application No. 18215358.5 filed on Dec. 21, 2018.

FIELD OF THE INVENTION

The invention relates to a method for off-gas composition control in a smelting apparatus for the reduction and melting of a metalliferous feed material, typically iron ores. More in particular the method is aimed at providing an off-gas that is directly or almost directly suitable for carbon capture and storage (CCS) and/or for carbon capture and utilisation (CCU).

BACKGROUND OF THE INVENTION

In conventional blast furnace (BF) ironmaking technology, the feed material comprising iron oxides is converted to liquid metal by reduction and melting wherein carbon is used for the reduction of the iron oxides. The carbon, supplied in the form of coke and/or coal, binds the oxygen of the iron ores by forming CO and CO2 gases.

The heat that is needed to melt the ores and to boost the chemical reactions in the reduction and melting process is provided by injecting pre-heated air (hot blast) into the BF. In this manner the process gas from the BF contains a large amount of nitrogen (>50%), as well as CO (20%), hydrogen and water vapour. In order to separate CO2 from the process gas, all other components have to be removed, or, vice versa, the CO2 molecules have to be stripped. The separation of CO2 gas is necessary either for CCS or alternatively for CCU purposes.

The known Hlsarna process is carried out in a smelting apparatus that includes (a) a smelting vessel provided with solids injection lances and oxygen-containing gas injection lances and is adapted to contain a bath of molten metal and (b) a smelt cyclone for partly reducing and smelting a metalliferous feed material which is positioned above and is in communication with the smelting vessel. The Hlsarna process and the apparatus for the process are described in WO 00/022176.

In the Hlsarna process an oxygen containing gas is used instead of hot blast, wherein the oxygen will react with injected coals to provide the necessary heat for melting the iron ores and enhancing the chemical reactions. The primary process gas therefore mainly comprises CO, CO2, H2 and H2O. In the smelt cyclone, the CO and/or H2 are fully or almost fully utilised by the injected ores and oxygen. The oxygen flow in the Hlsarna process can be controlled accurately and by means of that the post combustion gas ratio can be controlled, yielding a small amount of either CO or O2 in the off-gas.

Still the off-gas resulting from the Hlsarna process is not ready for immediate use for CCS or for CCU purposes because the CO2 concentration in the off-gas is still not high enough to be able to use the off-gas directly for CCS or CCU purposes. This means that further measures have to be provided to separate the CO2 from the off-gas, which on an industrial scale means large capital investments, high operating costs and high energy usage.

Objectives of the Invention

It is an objective of the present invention to provide a method for off-gas composition control, wherein the off-gas results from a smelting apparatus, such that the resulting off-gas is suitable for CCS.

It is another objective of the present invention to provide a method for off-gas composition control, wherein the off-gas results from a smelting apparatus, such that the resulting off-gas is suitable for CCU purposes.

It is another objective of the present invention to provide a method for off-gas composition control which results in a volume CO2 in the off-gas of at least 80%.

It is another objective of the present invention to provide a method for off-gas composition control which can be implemented easily.

It is another objective of the present invention to provide a method for off-gas composition control which can be operated at relatively low costs.

DESCRIPTION OF THE INVENTION

The invention relates to a method as defined in claims 1-15. One or more of the objectives of the invention are realised by providing a method for off-gas composition control, wherein the off-gas results from a smelting apparatus for smelting a metalliferous feed material, wherein the smelting apparatus comprises a smelting vessel, a smelt cyclone mounted on the smelting vessel and in connection with the inside of the smelting vessel and an off-gas duct connected to the smelt cyclone, and wherein the method comprises the steps of:

- injecting the feed material with a carrier gas into the smelt cyclone,
- injecting an oxygen containing gas into the smelt cyclone,
- injecting coal with a carrier gas into the smelting vessel,
- injecting an oxygen containing gas into the smelting vessel,
- optionally injecting fluxes with a carrier gas into the smelting vessel, wherein the oxygen containing gas contains 95% oxygen or more and wherein the carrier gas is not a nitrogen gas.

With the term "nitrogen gas" any gas is meant that contains 50% or more nitrogen. However, for the control of the off-gas the amount of nitrogen in the carrier gas should be as low as commercially viable for the complete process.

The term "metalliferous feed material" is to be understood as being predominantly iron ores and other or iron containing materials, but the feed material could also contain other metal and metal compounds.

By using an oxygen containing gas which contains about 95% of oxygen instead of air most or almost all components are removed from the oxygen containing gas which may ultimately result in impurities in the final off-gas stream. Any impurities, such as for instance N2, H2, Ar, O2, H2O, SOx, NOx, HCl, HF, CO, H2S and trace metals, in the final off-gas stream may result in changes in the CO2 phase diagram and consequently in that higher pressures are needed to keep the density of CO2 in a predefined range which is most suitable for an cost effective handling of the CO2 gas. The concentration of non-condensable gases such as for example nitrogen and argon should be limited not only to prevent the need for higher pressures for transport, but also because these gases may have a negative effect on the storage capacity of geological formations in which the carbon dioxide is to be stored.

In order to avoid any undesired components in the off-gas the oxygen supply should be as pure as possible at least as possible on an industrial scale. For that reason it is preferably provided that the oxygen containing gas contains at least 95% oxygen. With that the possible influence resulting from undesired components in the oxygen supply on the final off-gas and therewith the CO2 in the off-gas is limited to the largest extent possible. With the use of almost pure oxygen the volume of CO2 in the off-gas is already in the order of 70-75%.

By using commercially available almost pure oxygen gas, which contains about 99% or even about 99.5% oxygen, the resulting CO2 volume is further increased. Since this increase is at great costs it is in most cases economically more viable to use 95% oxygen containing gas. Other components in the 95% oxygen containing gas are about 2% Ar and about 3% N2.

Another source of gases that has to be controlled in order to realise an off-gas with a high CO2 concentration are carrier gases used for the injection of feed material, coals and fluxes, typically air and nitrogen gas. For that reason it is provided that the carrier gas used for the injection of metalliferous feed material, coal and optionally fluxes is not a nitrogen gas.

According to a further aspect of the invention the metalliferous feed material is injected into the smelt cyclone with a hydrocarbon gas as carrier gas. In the same manner also the coal is injected into the smelting vessel with a hydrocarbon gas as carrier gas. The optional fluxes can also be injected into the smelting vessel with a hydrocarbon gas as carrier gas.

All hydrocarbon gases react with oxygen in a combustion reaction, although the higher the number of carbon atoms in the hydrocarbon gas the more difficult it will become to start the combustion reaction. For that reason either methane, ethane or propane is used as carrier gas, alternatively also a mixture of these hydrocarbon gases could be used as carrier gas.

The equation for the reaction between the hydrocarbon gas and oxygen is:

$$C_nH_{2n+2}+(3n/2+1/2)O_2 \rightarrow (n+1)H_2O+nCO_2$$

With these hydrocarbon carrier gases it is important that sufficient oxygen is available for the reaction to avoid incomplete combustion resulting in carbon monoxide or carbon, which might complicate the total gas control in the smelting vessel and smelt cyclone.

Moreover, the combustion of hydrocarbon gases results in a substantial amount of H2O. For CCS the amount of water should be limited to prevent possible corrosion resulting from the formation of carbonic acid or corrosion resulting from a combination with sulfur components.

According to another aspect of the invention the metalliferous feed material is injected into the smelt cyclone with a carbon dioxide containing gas as carrier gas. With a carbon dioxide containing gas a gas is meant that contains at least 70% carbon dioxide. In the same manner also coal is injected into the smelting vessel with a carbon dioxide containing gas as carrier gas. The optional fluxes can also be injected into the smelting vessel with a carbon dioxide containing gas as carrier gas. The use of a carbon dioxide containing gas as carrier gas does not have the possible problems associated with the use of hydrocarbon gases as a carrier gas.

With the use of a carbon dioxide containing gas as carrier gas care should be taken that impurities resulting from the smelting process are not fed back into the smelting process. For that reason it is provided that the carbon dioxide containing gas for use as a carrier gas is the off-gas, resulting from smelting of the metalliferous feed material in the smelt cyclone and the smelting vessel, after cleaning and cooling of the off-gas.

Because of the high temperature of the off-gas directly after leaving the smelt cyclone it is necessary to cool the off-gas in order to prevent that droplets of liquid metal, feed material or any other material are taken further downstream and possibly adhere to the wall of the off-gas duct. For that reason the cooling of the off-gas resulting from the smelting of the metalliferous feed material includes the quenching of the off-gas by means of a quenching medium, which is carried out as soon as reasonably possible after the off-gas leaves of the smelt cyclone. The off-gas is quenched in the off-gas duct therewith cooling any droplets to a temperature well below the solidification temperature thereof.

In known gas quench systems air or water is used as quenching medium therewith introducing a lot of nitrogen gas or water vapour in the cooled off-gas which is to be avoided as much as possible if the off-gas is to be processed to be suitable for CCS or CCU purposes.

Accordingly, it is provided that the quenching medium is a carbon dioxide containing gas. More in particular it is provided that the quenching medium is the off-gas resulting from smelting of the metalliferous feed material after cleaning and cooling of the off-gas. In order to be able to use a carbon dioxide containing gas as a quenching medium the temperature of the carbon dioxide containing gas should be sufficiently lowered at the point where the carbon dioxide containing gas is taken from the off-duct. This will be at the point where the off-gas has a carbon dioxide gas content which is suitable for use of the off-gas for CCS and/or CCU purposes. It is provided that the carbon dioxide containing gas or the final off-gas that is used as quenching medium is cooled to a temperature in a range of 20-200° C., typically in a range of 20-100° C. In practice good results were realised with a temperature in the order of 50° C. for the carbon dioxide containing gas used as quenching medium.

In order to clean the off-gas as much as possible to further increase the CO2 content in the off gas it is provided that any water vapour present in the off-gas resulting from smelting the feed material is removed from the off-gas by means of condensation. As explained above it should be avoided to have water vapour in the final off-gas as much as possible. This is done in a CO2 processing unit wherein the off-gas that is used for CCS and/or CCU is even further purified, dried, cooled and compressed.

It is further provided that the off-gas resulting from smelting the feed material is passed through a SOx scrubber to remove sulphur compounds.

It is further provided that the off-gas resulting from smelting the feed material is passed through a dust cyclone to remove dust present in the off-gas.

Finally it is provided that the off-gas resulting from smelting the feed material is passed through a gas scrubber to remove any NOx components that might still be present in the off-gas. This is done upstream of the CO2 processing unit or before discharging that part of the off-gas which is not further processed for CCS and/or CCU purposes.

All these off-gas cleaning operations are carried out downstream of the point where the off-gas is quenched.

Although with the measures of using oxygen as pure as possible on an industrial scale and the use of a carbon dioxide containing gas or a hydrocarbon gas as carrier gas the CO2 content of the off-gas is in the range of 80-89% it is important to remove all components that could adversely affect the off-gas as much as possible when the off-gas is processed for the storage/sequestration of the CO2 gas.

The coal used in the smelting process contains small amounts of nitrogen as well as small amounts of sulphur. These are to be considered as impurities, since hydrogen sulphide (H2S), $NO_x$ and $SO_x$ may be formed which can reduce the pH of water present in the rock formation of the reservoir used for CO2 storage and may affect porosity and permeability of the reservoir.

With the measures according to the invention an off-gas is realised with a CO2 content in a range of 80-89%. The off-gas with a CO2 content in that range is suitable to be used as carrier gas and quenching medium. The volume of the off-gas that is used for CCS and/or CCU is finally processed in a CO2 processing unit wherein the off-gas is even further purified, dried, cooled and compressed. After this stage most if not all of the impurities are removed that could affect storage of the CO2 gas a purity of 99% CO2 can be realised. The same applies if the CO2 gas is to be used for CCU purposes.

BRIEF DESCRIPTION OF THE DRAWING

The invention will be further explained on hand of the example shown in the drawing, in which schematically a smelting vessel, smelt cyclone and off-gas duct with cleaning and cooling devices is shown.

DETAILED DESCRIPTION OF THE DRAWING

In the drawing a smelting apparatus 1 is shown which has a smelt cyclone 2 and below the smelt cyclone a smelting vessel 3. The smelt cyclone 2 is provided with injections lances 4 to feed a metalliferous feed material such as iron ore into the smelt cyclone together with flux as far as necessary by means of an conveying gas. For the heating and partial melting of the injected iron ore oxygen is injected into the smelt cyclone 2 by means of a set of oxygen lances 5. The oxygen injected is typically oxygen gas purified for industrial purposes with a purity of about 95% O2.

The smelting vessel 3 is provided with oxygen lances 12 in shell or roof portion 11 of the smelting vessel 3 to inject oxygen above the slag level when the smelting apparatus is in operation to adjust heating and reduction requirements of the process. The same purified oxygen gas is used as above described.

Further lances 6 are provided to inject coal and/or additives in the slag layer 7. For the injection iron ore through injection lances 4 and the injection of coal and additives through lances 6 recycled off-gas is used containing 80-89% CO2.

The molten iron 8 produced in the smelting reduction process is continuously discharged from the vessel 3 through a forehearth 9. The slag 7 resulting from the process is discharged from smelting vessel 3 by sequential tapping through a slag tap hole 10.

The off-gas is guided through an inclined off-gas duct part 15 downstream of the smelting vessel and the smelt cyclone. The inclined off-gas duct part has an inclination in the range of 50-90°, typically 60-70° to the vertical which provides that any liquid iron that is entrained in droplets by the off-gas will end up against the wall of the inclined duct part and will flow back and end up in the smelting vessel. In this manner most of the iron droplets present in the off-gas can be recovered resulting in that more than 90% of the iron present in the off-gas can be recovered. In recent trials the results were even better and it was determined that even 99% of the iron present in the off-gas was recovered. Instead of the inclined off-gas duct part other forms are possible as well such as a twisted duct part, a spiraled duct part, an undulating duct part and the like as long as the shape is such that the entrained iron droplets will end up against the wall of such duct part. The temperature in the inclined off-gas duct part 15 is in a range of 1600-1900° C.

The inclined off-gas duct part 15 is followed by a cooling/quenching device 16 in the off-gas duct 14 with which the temperature of the off-gas is lowered to a temperature of 1200° C. or lower. The quenching medium is recycled off-gas with a CO2 content in a range of 80-89%. The CO2 content in the recycled off-gas could even be higher if oxygen gas with a purity of 99% or even 99.5% is used in the process.

In this example the off-gas is further cooled by means of heat exchange with a steam driven electric generator device 17 further downstream of the cooling/quenching device 16. Cooling with other means is also possible with for instance ventilator cooling, but cooling wherein at least part of the heat energy is recovered is preferred. After passing the steam driven electric generator 17 the off-gas goes through a cold cyclone dust separator 18 wherein the off-gas is at least partially cleaned. Instead of a cold dust cyclone 18 also a high temperature dust cyclone could be used which should be positioned upstream of steam driven electric generator 17 and downstream of the cooling/quenching device 16, for instance at the horizontal duct portion at the top of duct 14.

After passing through hot or cold dust cyclone and steam driven electric generator 17 the off-gas goes through the bag filter 19 wherein most if not almost all dust is removed from the off-gas.

Downstream of the bag filter or bag house 19 a desulphurisation unit 21 is provided for the removal of SOx compounds. Part of the cleaned off-gas after the desulphurisation unit 21 is used as cooling gas for the cooling/quenching device 16 for which a return duct 23 with compressor 26 is provided. By compressing the off-gas at least part of the water vapour in the off-gas will condense and the condensed water is subsequently removed from the return duct 23. For the use of the cooling gas in the cooling/quenching device an overpressure with respect to the pressure in duct 14 is needed. In the given example an overpressure in the order of 10 to 500 kPa is enough to get a sufficient amount of cooling gas in duct 14 to cool the off-gas.

For the carrier gas for injecting iron ore through lances 4 into cyclone 2 and/or injecting coal and/or additives through lances 6 into the slag layer 7, the cleaned off-gas after the desulphurisation unit 21 can be used. To this end a return duct with compressor connected to the main duct after the desulphurisation unit 21 should be provided. The cleaned and cooled off-gas at this point has a CO2 content in the range of 80-89%. In one of the trials an off-gas was obtained with 88.8% CO2, 2.4% O2, 4.6% N2 and 4.0% H2O.

Alternatively the carrier gas for injecting iron ore through lances 4 into cyclone 2 and/or injecting coal and/or additives through lances 6 into the slag layer 7 can be taken from the CO2 processing unit 27 as described further below.

In order to pass the off-gas through the off-gas duct 14, cooling/quenching device 16, steam driven electric generator 17, cold dust cyclone 18, and bag filter 19 a fan 20 is provided in the off-gas duct 14 downstream of the bag filter 20. The fan 20 is not necessary if the smelting vessel 3 is operated at sufficient pressure.

The volume of the off-gas that is used for CCS is taken from the main duct and fed through duct 25 to a CO2 processing unit 27 wherein the off-gas is further purified, dried, cooled and compressed. In duct 25 the off-gas is passed through a gas scrubber (not shown) to remove any NOx components that might still be present in the off-gas. For CCS purposes it is necessary to compress the off-gas for which the processing unit 27 is provided with compressors 28,29,30. The off-gas is compressed in successive stages to a final overpressure in the order of 8-15 MPa or any other overpressure as might be required by the specifications of the installation used for the purpose. After processing unit 27 the compressed gas is further transported through duct 31. After this stage most if not all of the impurities are removed that could affect storage of the CO2 gas a purity of 99% CO2 can be realised.

In the example given in the drawing the carrier gas for injecting iron ore through lances 4 into cyclone 2 and/or injecting coal and/or additives through lances 6 into the slag layer 7 is taken from the CO2 processing unit 27. A return duct 24 is provided after the first compressor 28 of the CO2 processing unit 27 is provided. After the first compressor 28 the carrier gas used for injection has an overpressure which is suitable for the purpose. With the installation shown in the drawing this is in the order of 1-3 MPa.

The part of the off-gas that is not used for either CCS and CCU is discharged through stack 22 but not before the NOx component in the off-gas is removed as far as possible.

The invention claimed is:

1. A method for off-gas composition control, wherein the off-gas results from a smelting apparatus for smelting a metalliferous feed material, wherein the smelting apparatus comprises a smelting vessel, a smelt cyclone mounted on the smelting vessel and in connection with the inside of the smelting vessel and an off-gas duct connected to the smelt cyclone, and wherein the method comprises the steps of:

injecting the metalliferous feed material with a first carrier gas into the smelt cyclone, wherein the first carrier gas comprises at least one hydrocarbon gas selected from methane, ethane and propane, or comprises at least 70 volume % carbon dioxide, injecting an oxygen containing gas into the smelt cyclone, injecting coal with a second carrier gas into the smelting vessel, wherein the second carrier gas comprises at least one hydrocarbon gas selected from methane, ethane and propane, or comprises at least 70 volume % carbon dioxide, injecting an oxygen containing gas into the smelting vessel, optionally injecting fluxes with a third carrier gas into the smelting vessel, wherein the third carrier gas comprises at least one hydrocarbon gas selected from methane, ethane and propane, or comprises at least 70 volume % carbon dioxide, wherein the oxygen containing gas contains 95 volume % oxygen or more and wherein the first carrier gas, the second carrier gas, and the third carrier gas are not a nitrogen gas, discharging the off gas from the smelting apparatus, wherein the off gas has a CO2 content of 80-89 volume %.

2. The method according to claim 1, wherein the oxygen containing gas contains at least 95 volume % oxygen.

3. The method according to claim 2, wherein the metalliferous feed material is injected into the smelt cyclone with a hydrocarbon gas as the first carrier gas.

4. The method according to claim 1, wherein the metalliferous feed material is injected into the smelt cyclone with a hydrocarbon gas as the first carrier gas.

5. The method according to claim 4, wherein methane, ethane or propane is used as the second carrier gas.

6. The method according to claim 1, wherein the coal is injected into the smelting vessel with a hydrocarbon gas as the second carrier gas.

7. The method according to claim 6, wherein methane, ethane or propane is used as the second carrier gas.

8. The method according to claim 1, wherein the metalliferous feed material is injected into the smelt cyclone with a carbon dioxide containing gas as the first carrier gas.

9. The method according to claim 8, wherein the carbon dioxide containing gas for use as the first carrier gas is the off-gas resulting from smelting of the metalliferous feed material after cleaning and cooling of the off-gas.

10. The method according to claim 9, wherein the cooling of the off-gas resulting from the smelting of the metalliferous feed material includes the quenching of the off-gas by means of a quenching medium.

11. The method according to claim 10, wherein the quenching medium is a carbon dioxide containing gas.

12. The method according to claim 11, wherein the quenching medium is the off-gas resulting from smelting of the metalliferous feed material after cleaning and cooling of the off-gas, wherein the carbon dioxide containing gas is cooled to a temperature in a range of 20-200° C.

13. The method according to claim 11, wherein the quenching medium is the off-gas resulting from smelting of the metalliferous feed material after cleaning and cooling of the off-gas, wherein the carbon dioxide containing gas is cooled to a temperature in a range of 20-100° C.

14. The method according to claim 10, wherein the quenching medium is the off-gas resulting from smelting of the metalliferous feed material after cleaning and cooling of the off-gas.

15. The method according to claim 10, wherein the carbon dioxide containing gas is cooled to a temperature in a range of 20-200° C.

16. The method according to claim 10, wherein the carbon dioxide containing gas is cooled to a temperature in a range of 20-100° C.

17. The method according to claim 1, wherein the coal is injected into the smelting vessel with a carbon dioxide containing gas as the second carrier gas.

18. The method according to claim 1, wherein water vapour present in the off-gas resulting from smelting the metalliferous feed material is removed from the off-gas by means of condensation.

19. The method according to claim 1, wherein the off-gas resulting from smelting the metalliferous feed material is passed through a SOx scrubber to remove sulphur compounds.

20. The method according to claim 1, wherein the off-gas resulting from smelting the metalliferous feed material is passed through a dust cyclone to remove dust present in the off-gas.

21. The method according to claim 1, wherein the off-gas resulting from smelting the metalliferous feed material is passed through a gas scrubber to remove NOx components present in the off-gas.

* * * * *